US005592984A

United States Patent [19]

Schmiedeknecht et al.

[11] Patent Number: 5,592,984

[45] Date of Patent: Jan. 14, 1997

[54] INVESTMENT CASTING WITH IMPROVED FILLING

[75] Inventors: Dean L. Schmiedeknecht, Whitehall; Mark J. Straszheim, North Muskegon; Dennis J. Thompson, Whitehall, all of Mich.; Brad L. Rauguth, Whiteland, Ind.

[73] Assignee: Howmet Corporation, Greenwich, Conn.

[21] Appl. No.: 394,006

[22] Filed: Feb. 23, 1995

[51] Int. Cl.[6] ..... B22D 27/15; B22D 27/09; B22D 27/00

[52] U.S. Cl. ..... 164/62; 164/120; 164/68.1; 164/122.1; 164/256

[58] Field of Search ..... 164/62, 120, 66.1, 164/68.1, 47, 122.1, 122.2, 259, 253, 256

[56] References Cited

U.S. PATENT DOCUMENTS

| | | | |
|---|---|---|---|
| 3,977,462 | 8/1976 | Ohara | 164/256 |
| 4,832,105 | 5/1989 | Nagan et al. | 164/61 |
| 5,226,946 | 7/1993 | Diehm et al. | 75/10.14 |
| 5,335,711 | 8/1994 | Paine | 164/120 |

FOREIGN PATENT DOCUMENTS

| | | | |
|---|---|---|---|
| 2-220763 | 9/1990 | Japan | 164/66.1 |

*Primary Examiner*—Joseph J. Hail, III
*Assistant Examiner*—I.-H. Lin
*Attorney, Agent, or Firm*—Edward J. Timmer

[57] ABSTRACT

A method of making a directionally solidified casting by casting a melt in a mold cavity of an investment mold having a core therein to form an internal casting surface feature involves evacuting the mold cavity while the investment mold is disposed on a chill member with the mold cavity communicating to the chill member, and introducing the melt into the evacuted mold cavity about the core so that the melt contacts the chill member for unidirectional heat removal and directional solidification. Then, gaseous pressure is applied to the melt cast in the mold cavity rapidly enough after introduction in the mold cavity to reduce localized void regions present in the cast melt as a result of surface tension effects between the melt and the core.

15 Claims, 3 Drawing Sheets

1.5X 1.5X

INVESTMENT CASTING WITH IMPROVED FILLING

FIELD OF THE INVENTION

The present invention relates to a method of casting a melt in a mold in a manner that improves filling of one or more mold cavities with the melt, especially about a ceramic core disposed in the mold cavity to form internal casting surface features.

BACKGROUND OF THE INVENTION

In the manufacture of components, such as nickel base superalloy turbine blades and vanes, for gas turbine engines, directional solidification investment casting techniques have been employed in the past to produce single crystal or columnar grain castings having improved mechanical properties at high temperatures encountered in the turbine section of the engine.

In the manufacture of turbine blades and vanes for modern, high thrust gas turbine engines, there has been a continuing demand by gas turbine manufacturers for internally cooled blades and vanes having complex, internal cooling passages including such features as pedestals, turbulators, and turning vanes in the passages to control the flow of air through the passages in a manner to provide desired cooling of the blade or vane. These small cast internal surface features typically are formed by including a complex ceramic core in the mold cavity in which the melt is cast. The presence of the complex core having small dimensioned surface features to form pedestals, turbulators, turning vanes or other internal surface features renders filling of the mold cavity about the core with melt more difficult and more prone to inconsistency. Wettable ceramics and increased metallostatic head on the mold have been used in an attempt to improve mold filling and reduce localized voids in such situations, but these are costly and may be restricted by physical size of the casting apparatus.

It is an object of the present invention to provide a method of casting a melt in a mold in a manner that improves filling of one or more mold cavities with the melt.

It is another object of the invention to provide a method of casting a melt in a mold in a manner that improves filling about a ceramic core disposed in a mold cavity to form cast internal surface features, especially fine or small dimensioned surface features, such as the pedestals, turbulators, and turning vanes described hereabove for internally cooled turbine blades and vanes.

It is another object of the invention to decrease the level of internal porosity formed during solidification of the melt.

It is still another object of the invention to provide a method of casting a melt in an evacuated mold-followed by rapid application of pressure on the melt cast in the mold in a manner that improves filling about a ceramic core disposed therein to form cast internal surface features, such as fine or small dimensioned cast internal surface features.

SUMMARY OF THE INVENTION

The present invention provides in one embodiment a method of casting a melt in a mold wherein the melt is introduced into an evacuated mold cavity and then gaseous pressure is applied to the melt cast in the mold cavity rapidly enough to reduce any localized void region present in the cast melt as a result of surface tension effects between the melt and a mold component, such as ceramic core surface and/or mold surface. The gaseous pressure is applied after the mold is filled with the melt rapidly enough to collapse one or more localized void regions in the melt prior to gas pressure equalization within the void regions by virtue of the gas permeation through the mold.

In an embodiment of the invention, the mold cavity initially is evacuated, the melt is introduced into the evacuated mold cavity, and the gaseous pressure is applied to the melt in the mold cavity immediately after it fills the mold cavity. The mold cavity can be evacuated by evacuating a vacuum casting chamber in which the mold is disposed and the gaseous pressure can be applied to the melt introduced to the mold cavity by backfilling the casting chamber with a pressurized gas. Preferably, the gaseous pressure comprises a pressurized gas that is substantially non-reactive with the melt, such as an inert gas.

In another particular embodiment of the invention for making a directionally solidified casting, a ceramic investment shell mold is disposed on a chill member with a mold cavity communicating to the chill member, the mold cavity is evacuated typically by the mold being disposed in an evacuated casting chamber, superalloy melt is introduced to the evacuated mold cavity about the core so that the melt contacts the chill member for unidirectional heat removal, and then gaseous pressure is applied to the melt cast in the mold cavity rapidly enough after introduction in the mold cavity to reduce (e.g. collapse) localized void regions present in the cast melt as a result of surface tension effects between the melt and the core and/or mold surfaces. The casting chamber is backfilled with a gas as a means of applying the gaseous pressure to the melt introduced to the mold cavity.

The present invention also provides apparatus for rapidly pressurizing a casting or other chamber (e.g. in about 2 seconds or less) wherein a pressure vessel, such as a surge tank, is provided having an internal volume and gas pressure therein selected in dependence on chamber volume to establish a predetermined pressure in the chamber, a fast acting valve that is completely openable in rapid manner, and a gas supply tube communicated to the fast acting valve and the chamber via an optional gas diffuser to reduce velocity of the gas entering the chamber.

DESCRIPTION OF THE INVENTION

Figure 1:
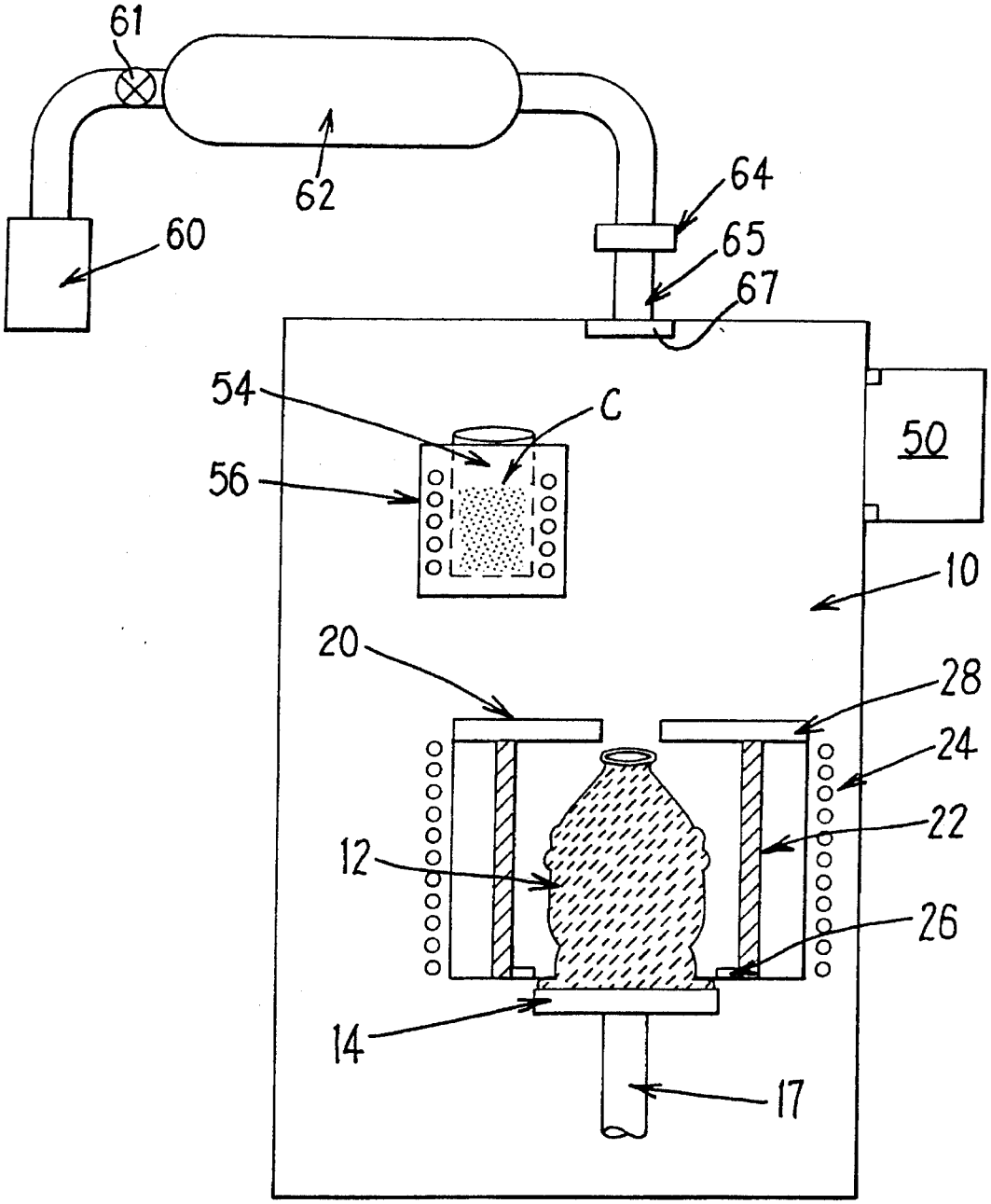
FIG. 1 is a schematic view of apparatus of an embodiment of the invention for making single crystal castings pursuant to a method embodiment of the invention, the mold assembly being shown schematically for purposes of convenience.
Figure 2:
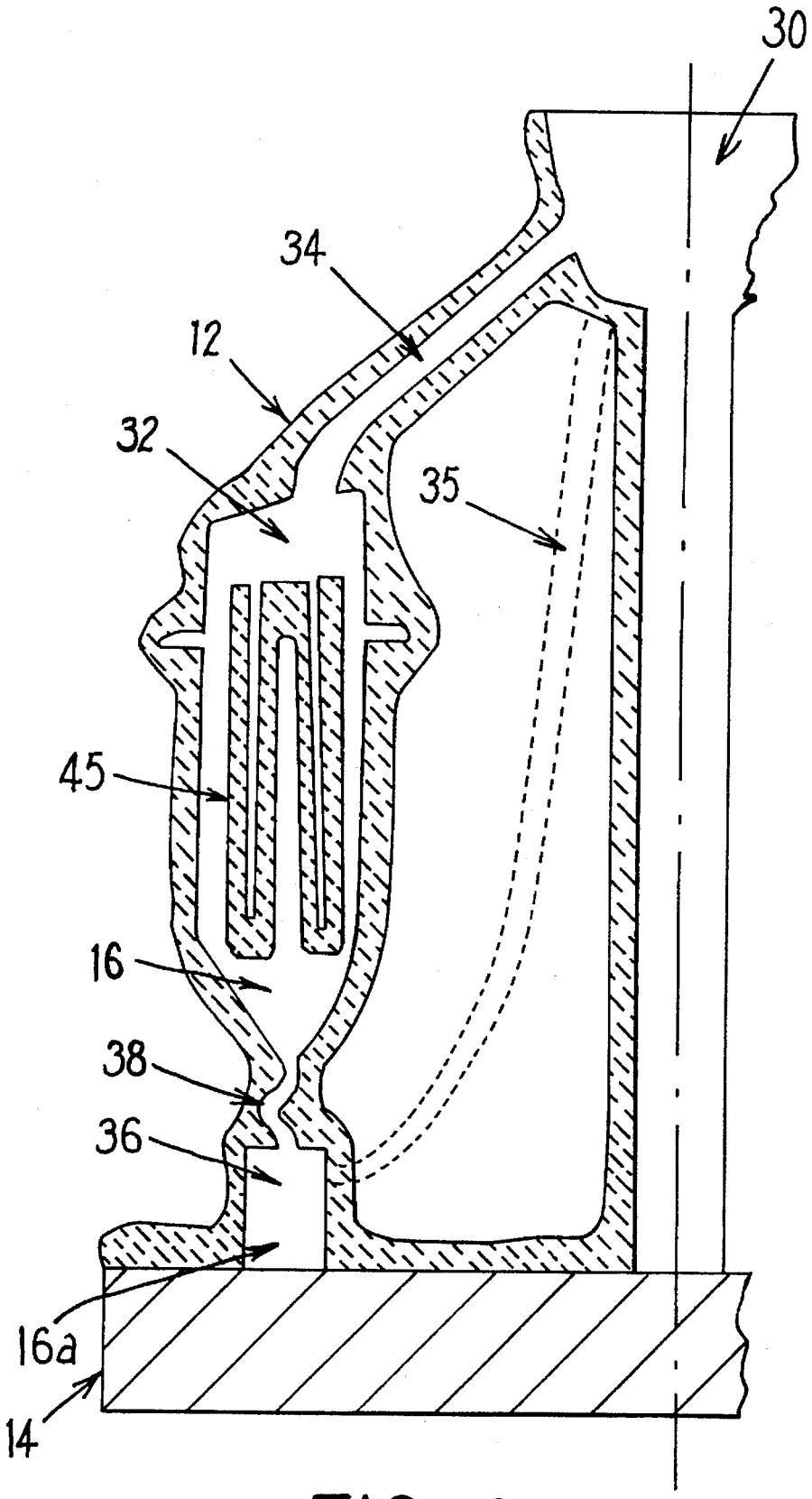
FIG. 2 is an enlarged, sectional view of the investment shell mold assembly of FIG. 1.

Referring to the FIGS. 1 and 2, casting apparatus for practicing an embodiment of the invention to produce a plurality of superalloy single crystal castings is illustrated for purposes of describing the invention, although the invention is not limited to the particular casting apparatus shown or to the casting of single crystal castings. The invention can be practiced in conjunction with a wide variety of casting equipment to produce equiaxed grain castings and directionally solidified castings having a single crystal, columnar grain, or directional eutectic microstructure of a variety of metals and alloys.

The apparatus includes a vacuum casting chamber 10 in which a ceramic investment shell mold assembly 12 is disposed on a chill member (plate) 14 in conventional manner. A portion of the mold assembly 12 is shown in more detail in FIG. 2 where it is apparent that each mold cavity 16 of the mold assembly 12 communicates to the chill member 14 via a mold cavity opening 16*a* at the lowermost or bottom thereof. The mold assembly 12 includes a plurality of mold cavities 16 disposed about the pour cup 30 as shown, for example, in U.S. Pat. No. 3,763,926, the teachngs of which are incorporated herein by reference with respect to an exemplary mold assembly configuration. The chill member 14 is disposed on a movable shaft 17 that effects withdrawal of the mold assembly 12 from a furnace 20 after the mold assembly 12 is filled with melt, such as a nickel or cobalt base superalloy, to effect directional solidification of the melt in the mold.

The furnace 20 is of conventional construction and includes a tubular susceptor 22 typically comprising a graphite sleeve and an induction coil 24 disposed about the susceptor 22 by which the susceptor is heated for in turn heating the mold assembly 12 prior to filling with the melt. Heat shields 26 are positioned at the lower end of the susceptor sleeve about and proximate the periphery of the chill member 14. A removable heat shield cover 28 is disposed on the top of susceptor 22 and may include an opening for receiving a melt which is introduced to an upper pour cup 30 of the mold assembly 12, FIG. 2.

The pour cup 30 of the mold assembly 12 communicates to filling passages 34 that in turn communicate to each mold cavity 16 for feeding of the mold with melt. An alternative melt filling passage 35 shown in dashed lines can be provided from the pour cup 30 to each growth cavity 16*a* to feed melt thereto such as shown in U.S. Pat. No. 3,763,926. The growth cavity 36 communicates with the mold cavity via a crystal selector passage 38, such as a pigtail or helical passage, such that one of the many crystals or grains propagating upwardly in the growth cavity from the chill member is selected for further propagation through the mold cavity thereabove to form a single crystal casting therein having a configuration complementary to the shape of the mold cavity, all as is well known. Above each mold cavity 16 is a riser cavity 32 that provides a source of melt to the mold cavity 16 to fill skrinkage during solidification as well as metallostatic pressure or head on the melt as it solidifies in the mold cavity 16.

The mold asssembly 12 typically comprises a ceramic investment shell mold assembly having the features described and formed by the well known lost wax process wherein a wax or other fugitive pattern of the mold assembly is dipped repeatedly in ceramic slurry, drained, and then stuccoed with coarse ceramic stucco to build up the desired shell mold thickness on the pattern. The pattern then is removed from the invested shell mold, and the shell mold is fired at elevated temperature to develop adequate mold strength for casting.

In the manufacture of internally cooled turbine blades or vanes, each mold cavity 16 will have the outer configuration of the desired blade or vane casting shape. The internal cooling passsage and related surface features of the blade or vane casting are formed by a ceramic core 45 disposed in each mold cavity 16 by chaplets, pins, and other known techniques which form no part of the present invention. As mentioned above, in the manufacture of turbine blades and vanes for modern, high thrust gas turbine engines, there has been a continuing demand by gas turbine manufacturers for internally cooled blades and vanes having complex, internal cooling passages including such features as pedestals, turbulators, and turning vanes in the passages to control the flow of air through the passages in a manner to provide desired cooling of the blade or vane. These small internal cast passage surface features are formed by including the complex ceramic core 45 in each mold cavity 16. The presence of the complex core 45 having small dimensional surface features to form pedestals, turbulators, turning vanes or other internal cast surface features, however, renders filling of the mold cavities 16 and the small dimensioned core surface features completely with melt more difficult and prone to inconsistency.

In particular, the inventors have discovered that the small dimensions of the cooling passages to be formed in the blade or vane as well as the small dimensions of the core surface features can promote surface tension effects between the melt and core and/or mold surfaces that result in localized void regions in the melt and thus in the resultant solidified castings. That is, the melt incompletely fills small dimensioned cavities between the core and adjacent mold surfaces and small dimensioned surface features on the core itself; for example, core surfaces configured to form pedestals, turbulators, and turning vanes in the solidified casting. For purposes of illustration, small cavities between the core and adjacent mold surfaces having a width dimension (wall thickness) of only 0.012 inch to 0.020 inch can be present to form external and internal wall thicknesses in the cast internally cooled blade or vane. Moreover, core surface features, such as circular cross-section pedestals, have diameters of only 0.020 inch to 0.030 inch. Such small dimensioned cavities and core surface features tend to exaggerate surface tension effects between the melt and the core and/or mold surfaces that prevent complete filling thereof with melt, resulting in localized void regions in the melt and thus in the solidified casting where there is incomplete melt filling.

Use of such techniques as particular ceramics selected to improve metallurgical wetting and increased metallostatic pressure to overcome the localized surface tension effects are costly and may be restricted by physical size constraints in the casting furnace. In practicing an embodiment of the present invention using the apparatus illustrated in the FIG. 1, the vacuum casting chamber 10 initially is evacuated by a vacuum pump 50 to a vacuum level of 5 microns or less. The mold cavities 16 likewise will be evacuted as a result of the mold assembly 12 being disposed in the vacuum chamber and being gas permeable. Also prior to introduction of melt, the mold assembly 12 is preheated to an elevated casting temperaure (e.g. 2800 degrees F. for a nickel base superalloy melt) by energization of the induction coil 24 disposed about the graphite susceptor 22. The preheat temperature for the mold assembly 12 depends on the type of melt being cast.

The nickel base superalloy melt is provided by melting a charge C of the superalloy in a crucible 54 disposed the evacuated vacuum chamber 10 by energization of an induction coil 56 about the crucible pursuant to conventional practice. The superalloy melt is heated to an appropriate superheat and then introduced to the mold assembly 12 by pouring from the crucible 54 into the pour cup 30 by suitable rotation of the crucible in known manner. The superheated melt flows down the filling passages 34 to each mold cavity 16 and then into each growth cavity 16*a*. Filling is complete when each riser cavity 32 is full to a level corresponding to the level of melt in the pour cup 30.

After the melt is poured into the mold assembly, fills the mold assembly and enters the riser cavities 32, the vacuum chamber 10 is backfilled with gas, such as typically inert gas (e.g. argon) or other gas that is substantially non-reactive with the superalloy melt in the mold assembly 12. Gaseous pressure thereby is applied to the melt introduced in the mold cavities 16. The gas pressure is ramped up rapidly enough to a sufficiently high pressure level after introduction and filling of the mold assembly with the melt to overcome and collapse localized void regions present in the cast melt as a result of surface tension effects between the melt and the core and/or mold surfaces, such as at the small dimensioned cavities and core surface features described above.

The time of gas pressurization typically is determined by the gas permeation rate of the gas permeable investment shell mold 12. In particular, the gaseous pressure is ramped up rapidly enough to collapse one or more localized void regions in the melt before gas pressure equalization within the void regions occurs as a result of gas permeation through the mold 12. Otherwise, gas pressure equalization within void regions in the melt can occur by virtue of gas permeation through the mold walls before collapse of void regions in the melt. The degree or magnitude of gas pressure applied typically is determined by the dimensions of the core features to be filled or contacted with melt. In casting nickel base superalloy melts in the manner described above in the production of single crystal turbine blade castings, the vacuum chamber was backfilled with high purity argon at different times (e.g. at times that ranged from greater than 0 to 20 seconds) following the time the riser cavities were observed visually to be filled with the melt during casting trials. Gas pressurization was established prior to withdrawal of the melt filled mold assembly 12 from the furnace 20 for melt directional solidification. As mentioned, gas pressurization is effected prior to gas pressure equalization within the void regions of the melt due to gas permeation through the gas permeable mold walls. For example, in casting trials, gas pressurization after 2 minutes following the time the riser cavities were observed to be filled with melt was ineffective to collapse void regions in the melt.

The argon was introduced into the vacuum chamber 10 from a pressure vessel 62, such as a surge tank, having an appropriate internal volume (e.g. 120 gallons for a vacuum chamber volume of 100 cubic foot) and having argon gas pressure therein (e.g. ranging from 5 psig to 50 psig) selected to establish the desired argon backpressure in the chamber 10 pursuant to the invention. The gas pressure is supplied from the vessel 62 through an electrically actuated, fast acting ball valve 64 that is able to open (or close) completely in very rapid manner (e.g. in less than one second) and a large diameter (e.g. 3 inches diameter) copper or other tube 65 communicated to the chamber 10. A gas diffuser 67 (shown schematically) is fastened to the top of the chamber 10 at the inlet of the tube 65 to the chamber 10 to reduce the velocity of the argon gas entering the chamber 10. The gas diffuser 67 comprises a stack of stainless steel rods of 0.5 inch diameter and 8 inches length arranged in three layers one atop the other and criss-crossed relative to one another, wherein the top layer includes 5 rods arranged parallel to one another and spaced about 0.5 inch apart, the middle layer includes 5 rods arranged parallel to one another and spaced about 0.5 inch apart yet perpendicular to the rods of the top layer, and the bottom layer includes 4 rods arranged parallel to one another and spaced about 0.5 inch apart yet perpendicular to the rods of the middle layer and located beneath the spaces between the rods of the top layer. The stacked, criss-crossed arrangement of rods provides a nearly optically opaque gas diffuser when viewing the diffuser perpendicular to the top layer thereof.

In lieu of using a gas diffuser 67 to control velocity of argon gas entering the chamber 10, the diameter of the tube 65 can be substantially increased to this end, such as from 3 inches to 6 to 8 inches in diameter.

A predetermined argon backfill pressure can be provided rapidly in the chamber 10 using the apparatus described and shown in FIG. 1. Typical backfill pressures of 0.5 to 0.9 atmospheres of argon can be achieved or established in the chamber 10 nearly instantaneously using the apparatus; e.g. in slightly more than one second, by the apparatus operator's pushing an electrical valve actuator button to open the fast acting valve 64 when the riser cavities are observed to be filled.

The final gas pressure in the chamber 10 is predetermined by controlling the initial gas pressure and volume of the pressure vessel 62. The pressure vessel 62 is filled from an argon gas source 60 via a shutoff valve 61 prior to discharging the pressure vessel 62 into the discharge tube 65 to ramp up gas pressure in the chamber 10.

In different casting trials, the backpressure of argon gas was maintained in the chamber 10 at the predetermined level for different times ranging from 0.1 minutes up to the time for complete mold withdrawal from the furnace 20. Alternately, the argon backpressure can be rapidly established after mold filling for a short time (e.g. 0.1–3 seconds) followed by evacuation of the chamber 10 to return to the inital vacuum level during subsequent mold withdrawal.

In casting trials, cored single crystal nickel base superalloy castings produced using such argon backpressure immediately after filling the mold assembly with melt yielded single crystal castings having reduced non-fill of 0.020 inch diamter pedestals as compared to single crystal castings produced using the same casting procedures but maintaining a vacuum in the vacuum chamber; i.e. without establishing the argon backpressure in the vacuum chamber pursuant to the invention. X-ray analysis revealed that none of the single crystal castings produced pursuant to the invention exhibited non-fill, whereas all of the single crystal castings produced without argon backpressure exhibited non-fill.

Figure 3A:
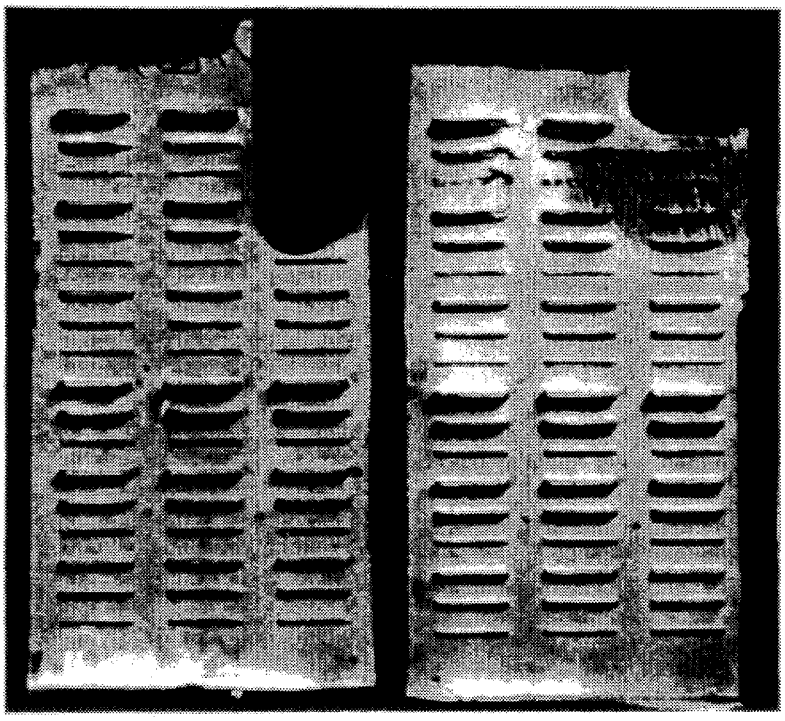
FIGS. 3A and 3B are photographs at 1.5X of single crystal test panels having turbolator features cast pursuant to conventional practice, FIG. 3A, and pursuant to the invention, FIG. 3B.
Figure 3B:
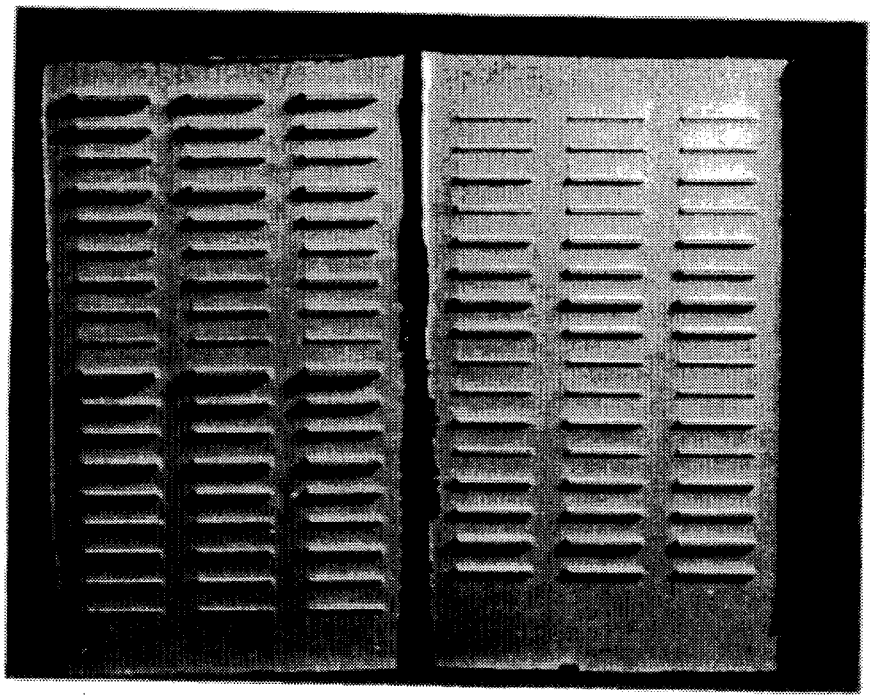

In other casting trials of single crystal test panels (shown in FIG. 3) containing various sizes of ceramic core details, commonly called turbulators, using argon backpressure in the vacuum chamber 10 pursuant to the invention immediately after filling of the mold assembly with melt yielded castings with 100% completeness (i.e. complete filling of the turbolator features with sharp turbolator edge detail as illustrated in FIG. 3B) as compared to castings made in a conventional manner as shown in FIG. 3A. Improved filling of the core details and a reduction in macroshrinkage were observed for the castings made pursuant to the invention as compared to conventional castings.

Further casting trials were conducted to make cored directionally solidified nickel based superalloy castings having columnar grain structure using a ceramic core with circular cross-section pedestals of size range of 0.020 to 0.025 inch diameter. In these trials, the final backpressure in the chamber pursuant to the invention was 0.5 atmosphere argon. These trials resulted in a casting rejection rate for incomplete filling of the smallest dimensional core pedestal features of only 3% as compared to similar castings made using conventional casting practice where the rejection rate for incomplete fill of the pedestal features was 17%. It is believed that a higher final backpressure of argon pursuant to the invention would result in further reduction of the casting rejection percentage to near zero.

It is to be understood that the invention has been described with respect to certain specific embodiments thereof for purposes of illustration and not limitation. The present invention envisions modifications, changes and the like can be made therein without departing from the spirit and scope of the invention as set forth in the following claims.

We claim:

1. A method of casting a melt, comprising introducing the melt into a mold cavity of a mold residing in a furnace in a casting chamber under an initial relative vacuum and then applying gaseous pressure to the melt introduced in the mold cavity while the mold resides in said furnace and prior to withdrawal of said mold from said furnaces, said gaseous pressure being applied rapidly enough after casting said melt in said mold to reduce localized void regions present in the cast melt as a result of surface tension effects between the melt and a mold component.

2. The method of claim 1 wherein the melt is cast into a mold cavity having a refractory core disposed therein and having a surface feature for forming an internal casting feature and wherein said application of gaseous pressure improves melt filling of the core surface feature.

3. The method of claim 1 wherein the mold cavity initially is evacuated, the melt is cast in the evacuated mold cavity, and said gaseous pressure is applied to said melt in said mold cavity immediately after it fills the mold cavity.

4. The method of claim 1 including the further step of evacuating the casting chamber after the gaseous pressure is applied to the melt in the mold to return the casting chamber to a relative vacuum during solidification of the melt in the mold.

5. The method of claim 1 wherein wherein the gaseous pressure comprises a pressurized gas that is substantially nonreactive with the melt.

6. The method claim 5 wherein the gas comprises an inert gas.

7. A method of investment casting a melt in a mold cavity having a core therein to form an internal casting surface feature, comprising evacuating the mold cavity of a mold disposed in a furnace of a casting chamber, introducing the melt into the evacuated mold cavity about the core and then applying gaseous pressure to the melt introduced in the mold cavity while the mold resides in said furnace and prior to withdrawal of said mold from said furnace, said gaseous pressure being applied rapidly enough after casting in the mold to reduce localized void regions present in the cast melt as a result of surface tension effects between the melt and the core.

8. The method of claim 7 wherein wherein the gaseous pressure comprises a pressurized gas that is substantially nonreactive with the melt.

9. The method claim 8 wherein the gas comprises an inert gas.

10. The method of claim 7 wherein the mold cavity is evacuated by evacuating a casting chamber in which the mold is disposed and the gaseous pressure is applied by backfilling the casting chamber with a pressurized gas.

11. A method of making a directionally solidified casting by casting a superalloy melt in a mold cavity of an investment mold having a core therein to form an internal casting surface feature, comprising evacuating the mold cavity of said mold disposed in a furnace in a casting chamber while the investment mold is disposed on a chill member with the mold cavity communicating to the chill member, introducing the melt into the evacuated mold cavity about the core so that the melt contacts the chill member for unidirectional heat removal, and then applying gaseous pressure to the melt introduced in the mold cavity while said mold resides in said furnace and prior to withdrawal of said mold from said furnace, said gaseous pressure being applied rapidly enough after introducing said melt in said mold cavity to reduce localized void regions present in the cast melt as a result of surface tension effects between the melt and the core.

12. The method of claim 11 wherein wherein the gaseous pressure comprises a pressurized gas that is substantially nonreactive with the melt.

13. The method of claim 11 wherein the mold cavity is evacuated by evacuating a casting chamber in which the mold is disposed and the gaseous pressure is applied by backfilling the casting chamber with a pressurized gas.

14. The method claim 12 wherein the gas comprises an inert gas.

15. The method of claim 14 wherein the casting chamber is backfilled to a pressure of about 0.5 to about 0.9 atmosphere with an inert gas.

* * * * *